US006827560B2

(12) United States Patent
Gatley, Jr. et al.

(10) Patent No.: US 6,827,560 B2
(45) Date of Patent: Dec. 7, 2004

(54) TWO-PIECE MOTOR COOLING AND EXHAUST DILUTING BLOWER HOUSING

(75) Inventors: William Stuart Gatley, Jr., Cassville, MO (US); Rex Allen Rothgangel, Belleville, IL (US); Joan Teresa Richter, Breese, IL (US)

(73) Assignee: Jakel Incorporated, Highland, IL (US)

( * ) Notice: Subject to any disclaimer, the term of this patent is extended or adjusted under 35 U.S.C. 154(b) by 48 days.

(21) Appl. No.: 10/116,315

(22) Filed: Apr. 4, 2002

(65) Prior Publication Data

US 2003/0198564 A1 Oct. 23, 2003

(51) Int. Cl.[7] ..... F04B 35/04
(52) U.S. Cl. ..... 417/423.14
(58) Field of Search ..... 417/423.14, 423.1, 417/423.8, 366, 367, 368, 360, 701, 53; 126/45, 116, 312; 60/752, 754, 755, 758, 760

(56) References Cited

U.S. PATENT DOCUMENTS

| | | | | |
|---|---|---|---|---|
| 5,352,099 A | * | 10/1994 | Anstine et al. | 417/366 |
| 6,231,311 B1 | * | 5/2001 | Gatley et al. | 417/53 |
| 6,398,512 B2 | * | 6/2002 | Stewart | 417/53 |
| 6,406,275 B1 | * | 6/2002 | Hoehn | 417/366 |
| 6,511,288 B1 | * | 1/2003 | Gatley, Jr. | 415/206 |
| 6,530,346 B1 | * | 3/2003 | Coones et al. | 122/4 R |

* cited by examiner

*Primary Examiner*—Charles G. Freay
(74) *Attorney, Agent, or Firm*—Thompson Coburn, LLP

(57) ABSTRACT

A two-piece blower housing may be used with a climate control furnace or with a water heater and provides cooling of the motor that rotates the blower fan and also provides dilution and cooling of exhaust gases drawn from the furnace or water heater. The housing is also constructed with one side that is positioned in a single plane that is easily mounted to a flat surface of the furnace or water heater and can be seated against the surface.

27 Claims, 8 Drawing Sheets

TWO-PIECE MOTOR COOLING AND EXHAUST DILUTING BLOWER HOUSING

BACKGROUND OF THE INVENTION (1) Field of the Invention

The present invention pertains to a blower housing that may be used with a climate control furnace or a water heater. The blower housing provides cooling of the motor that rotates the blower fan and provides dilution and cooling of exhaust gases drawn from the furnace or water heater. The housing is constructed of only two pieces and is designed to be easily mounted to a flat surface of the furnace or water heater.

(2) Description of the Related Art

Home or office furnaces and/or water heaters typically include a blower that operates to draw ambient air into the combustion chamber of the furnace or water heater and to expel exhaust gases or fumes from the furnace or water heater through an exhaust pipe or chimney. The typical blower includes a blower housing having a volute shape and a radial fan or a squirrel cage fan mounted in the blower housing. The blower housing has an inlet vent opening at its center communicating with the center of the fan and an outlet exhaust opening at the periphery of the volute shape communicating with the exhaust pipe or chimney. An electric motor is mounted to the blower housing on an opposite side of the housing from the inlet vent opening. The motor rotates the fan to cause the fan to draw exhaust gases and fumes into the center of the fan in the blower housing through the inlet vent opening and exhaust the gases and fumes from the housing through the outlet exhaust opening.

In use of the typical blower with a typical furnace, the inlet vent opening of the housing communicates with an outlet of the furnace heat exchanger. On operation of the blower motor and rotation of the blower fan, a vacuum is created by the fan in the blower housing that draws ambient air into the combustion chamber of the furnace where it mixes with the gas or other fuel combusted in the combustion chamber. The hot combustion gases and fumes produced by the combustion chamber are then drawn through the heat exchanger of the furnace by the blower. The blower fan draws the combustion gases and fumes from the heat exchanger into the blower housing and expels the combustion gases and fumes through the exhaust pipe or chimney communicating with the exhaust outlet of the blower housing.

The typical operation of the blower employed with a water heater is similar to that of the furnace. On operation of the blower, ambient air is drawn into the combustion chamber where it mixes with the gas or other fuel being combusted. The combustion gases and fumes are then drawn through the heat exchanger of the water heater where they heat the water contained in the heater. The combustion gases and fumes are then drawn from the heat exchanger and through the blower housing and are expelled through the exhaust pipe or chimney by the blower.

Improvements in the typical blower used with a furnace or a water heater have included modifications to the blower housing where rotation of the fan not only draws the combustion gases and fumes from the heat exchanger of the furnace or water heater into the housing before being expelled, but the fan also draws a flow of cooling air over the motor rotating the fan to cool the motor. Modifications to the blower housing have also enabled ambient air to be drawn directly into the blower housing to mix with the heated exhaust gases and fumes drawn into the blower housing to dilute and cool the exhaust gases and fumes with the ambient air prior to their being expelled through the exhaust pipe or chimney communicating with the blower housing. However, these modifications to the typical blower housing have complicated the constructions of the blower housing which increases their manufacturing cost. In addition, the modifications to the typical blower housing have also complicated the assembly of the blower housing to the furnace or water heater with which it is used, resulting in increasing the time required to assemble the housing to the furnace or water heater and thereby increasing the assembly cost of the furnace or water heater.

What is needed to overcome these disadvantages of prior art blower housings used with climate control furnaces and water heaters is a blower housing that provides the benefits of motor cooling and exhaust gas dilution and cooling in a simplified, inexpensive blower housing that is easily assembled to the furnace or water heater with which it is used.

SUMMARY OF THE INVENTION

The blower housing of the present invention overcomes disadvantages associated with prior art blower housings discussed earlier by providing a blower housing that both draws cooling air over the motor rotating the fan contained in the blower housing and draws cooling and diluting air into the exhaust gases and fumes drawn into the blower housing, where the blower housing has a simplified, inexpensive two-piece construction. In addition, the blower housing provides a compartment for the electrical circuitry that controls operation of the blower motor that encloses all of the circuitry components associated with the motor in the blower housing. Still further, the housing is designed with one side of the housing being positioned in a single plane that facilitates mounting of the one side of the housing on a flat surface of the furnace or water heater with which the blower is used.

The two-piece motor cooling and exhaust diluting blower housing of the invention is constructed with a fan compartment that contains the radial or squirrel cage fan of the blower. The fan compartment has a volute shape with an exhaust inlet opening in one side of the compartment and a shaft hole in an opposite side of the compartment. The peripheral wall of the volute-shaped fan compartment merges into a circular exhaust outlet opening.

The blower housing also has a motor compartment on the side of the fan compartment having the shaft hole. The motor is supported in the motor compartment with the motor shaft passing through the shaft hole to the fan contained in the fan compartment. An inlet vent opening passes through the motor compartment on an opposite side of the motor compartment from the fan compartment. An outlet vent opening exits the motor compartment adjacent its connection to the fan compartment. The inlet vent opening and the outlet vent opening of the motor compartment define a flow path of air that is drawn through the motor compartment on operation of the blower fan that cools the motor contained in the motor compartment.

The blower housing also includes a dilution compartment on the side of the fan compartment through which the exhaust inlet opening passes. The dilution compartment also communicates with the motor compartment through the vent outlet opening of the motor compartment. Thus, rotation of the fan in the fan housing draws exhaust gases through the dilution compartment and also draws cooling air through the motor compartment and mixes that cooling air with the exhaust gases in the dilution compartment before the mixed air and gases are drawn into the fan compartment.

The blower housing also includes a circuitry compartment that contains the electronic circuitry associated with the blower motor. The circuitry compartment is isolated from the fan compartment, the motor compartment and the dilution compartment except for a small opening to the motor compartment that allows the electric wiring of the motor to pass into the circuitry compartment and a small opening to the fan housing that allow a pressure sensor mounted in the fan compartment to communicate with the circuitry in the circuitry compartment.

Because much of the electronic circuitry that controls the operation of the blower motor is mounted on the exterior of the furnace or water heater with which the blower is used, the circuitry compartment is located at the side of the blower housing that is positioned in a single plane. In addition, because the dilution compartment communicates with the exhaust outlet of the furnace or water heater, the dilution compartment is also located at the side of the blower housing that is positioned in the single plane. This enables the blower housing to be mounted to a flat surface of the furnace or water heater with the circuitry compartment enclosing the circuitry components mounted on the flat surface and the dilution compartment enclosing the exhaust outlet of the furnace or water heater emerging from the flat surface.

The arrangements of the fan compartment, the motor compartment, the dilution compartment and the circuitry compartment in the blower housing enable the blower housing to be constructed of only two pieces with each piece being moldable of plastic or another similar material in a two-piece mold. In the two-piece housing construction, portions of the fan compartment, the motor compartment and the dilution compartment are provided on each piece to facilitate assembly of the fan and motor in their respective compartments.

DESCRIPTIONS OF THE DRAWINGS

Further features of the invention are set forth in the following detailed description of the invention and in the drawing figures wherein.

DETAILED DESCRIPTION OF A PREFERRED EMBODIMENT

Figure 1:
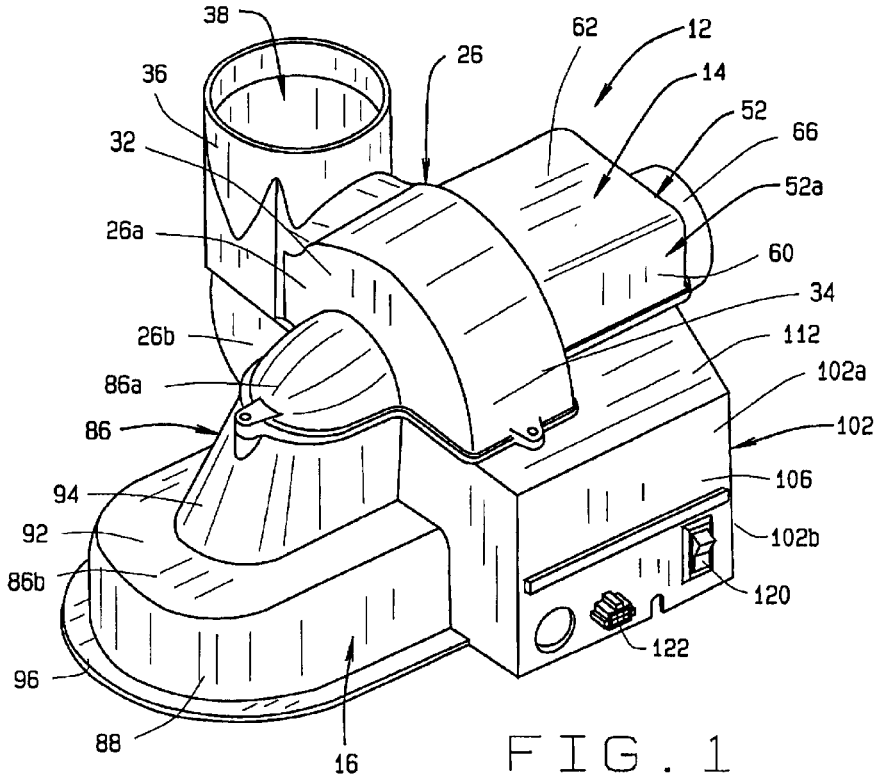
FIG. 1 is a perspective view of one side of the assembled two-piece blower housing of the invention.

As explained earlier, the blower housing of the invention has a simplified, inexpensive two-piece construction and is constructed to both draw cooling air over the motor rotating the fan of the blower and draw cooling and diluting air into the exhaust gases and fumes drawn into the blower housing by the fan. Because the specific construction of the fan, motor and motor electronic circuitry employed with the blower housing are not pertinent to the novel construction of the blower housing itself, these component parts of the blower are shown only schematically in the drawings. In addition, because the novel blower housing of the invention may be employed with a heating furnace or a water heater, the particular construction of the furnace or water heater is not shown in the drawing figures. Only the exhaust gas or fume exit pipe emerging from a flat surface of the furnace or water heater are shown in the drawing figures to illustrate the novel construction of the blower housing that enables it to be easily mounted to the furnace or water heater with which it is used. In the preferred embodiment of the invention, the two pieces of the blower housing to be described are molded of a plastic material. However, other similar types of materials and similar methods of manufacture may be employed.

Figure 2:
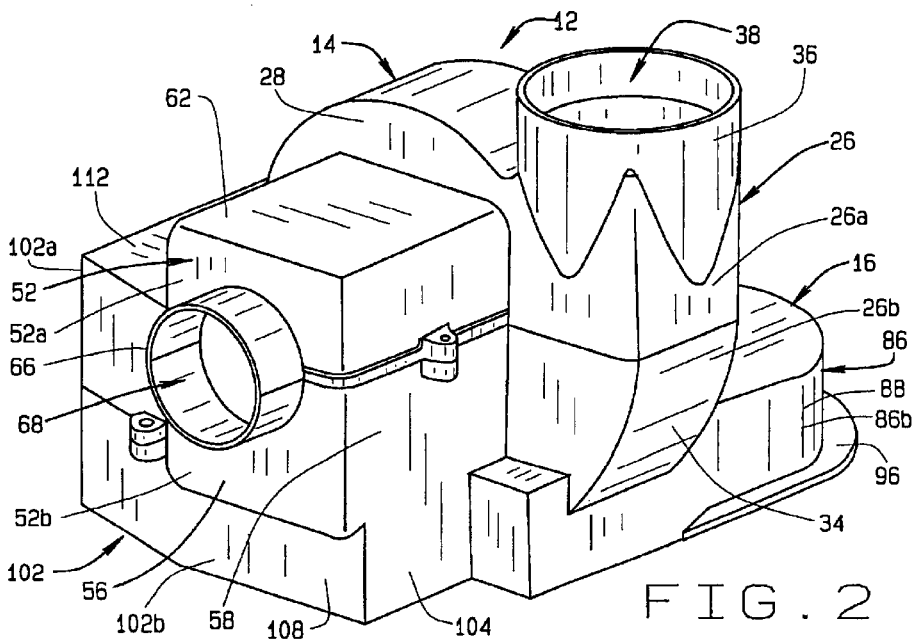
FIG. 2 is a perspective view of the opposite side of the blower housing shown in FIG. 1.
Figure 3:
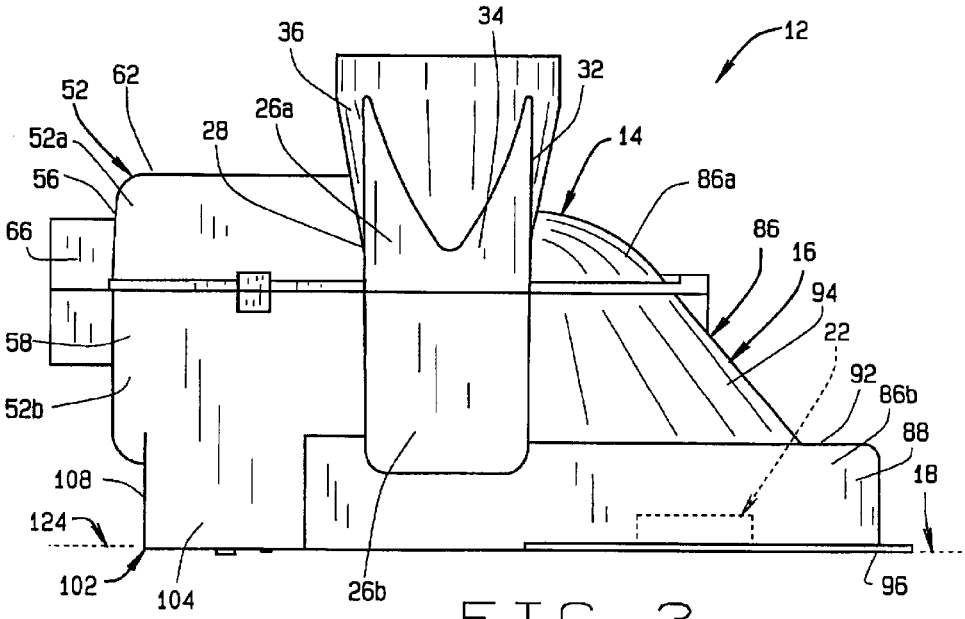
FIG. 3 is a side elevation view of the assembled two-piece blower housing of the invention.
Figure 4:
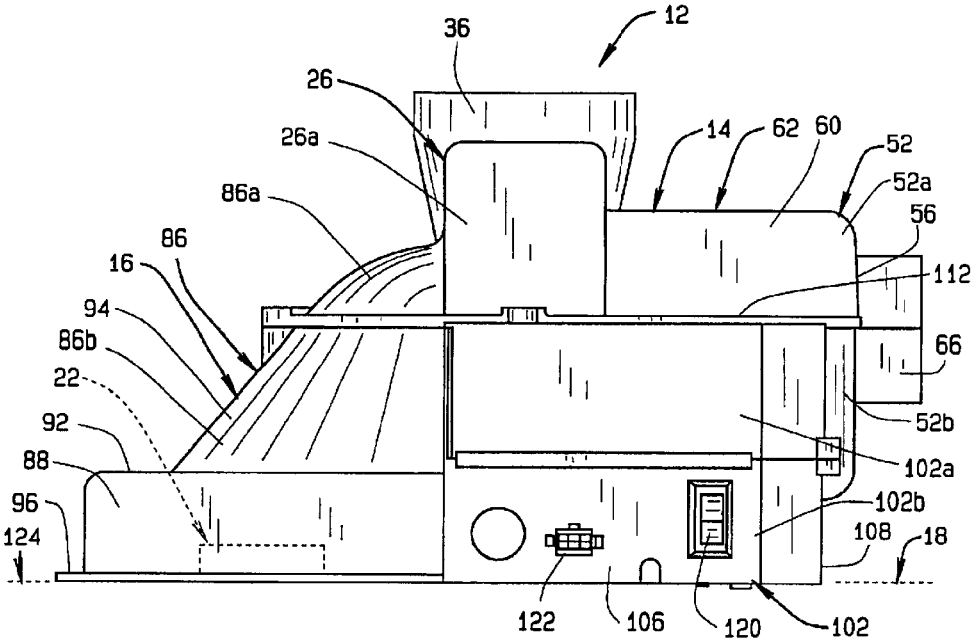
FIG. 4 is an elevation view of the side of the blower housing opposite that shown in FIG. 3.
Figure 5:
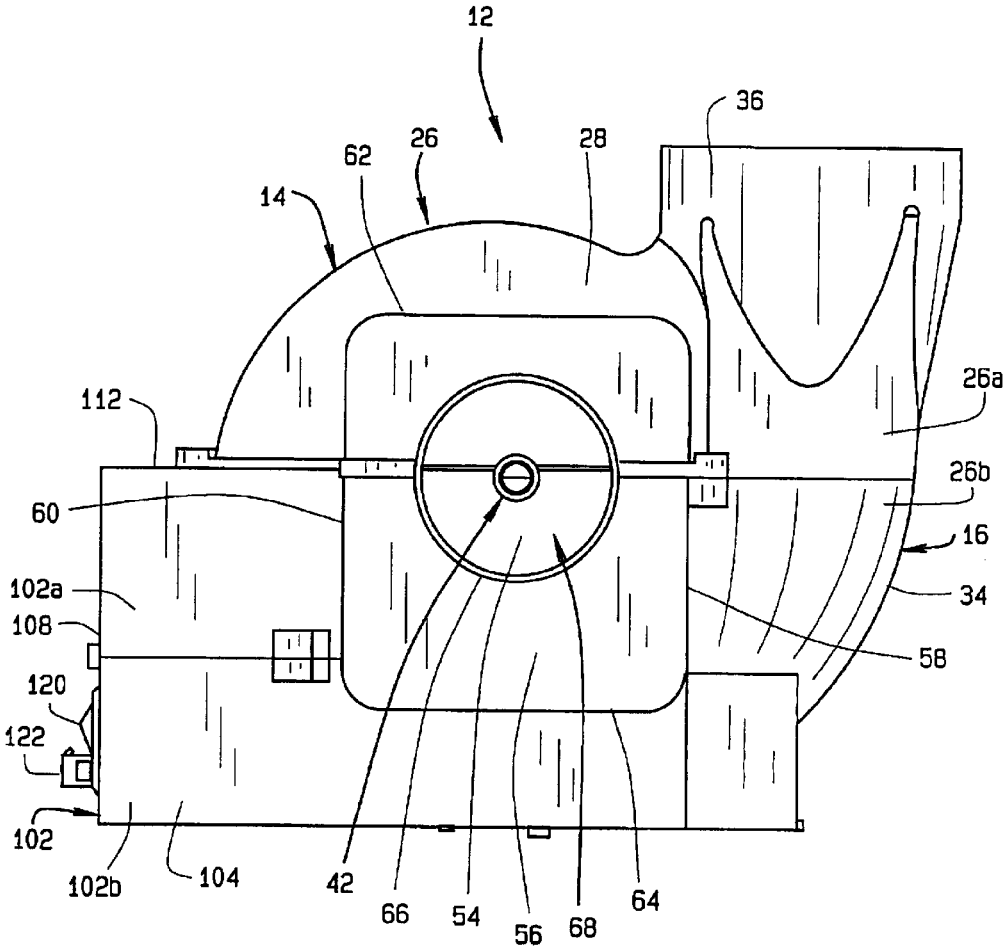
FIG. 5 is an end elevation view of the blower housing of FIG. 3.
Figure 6:
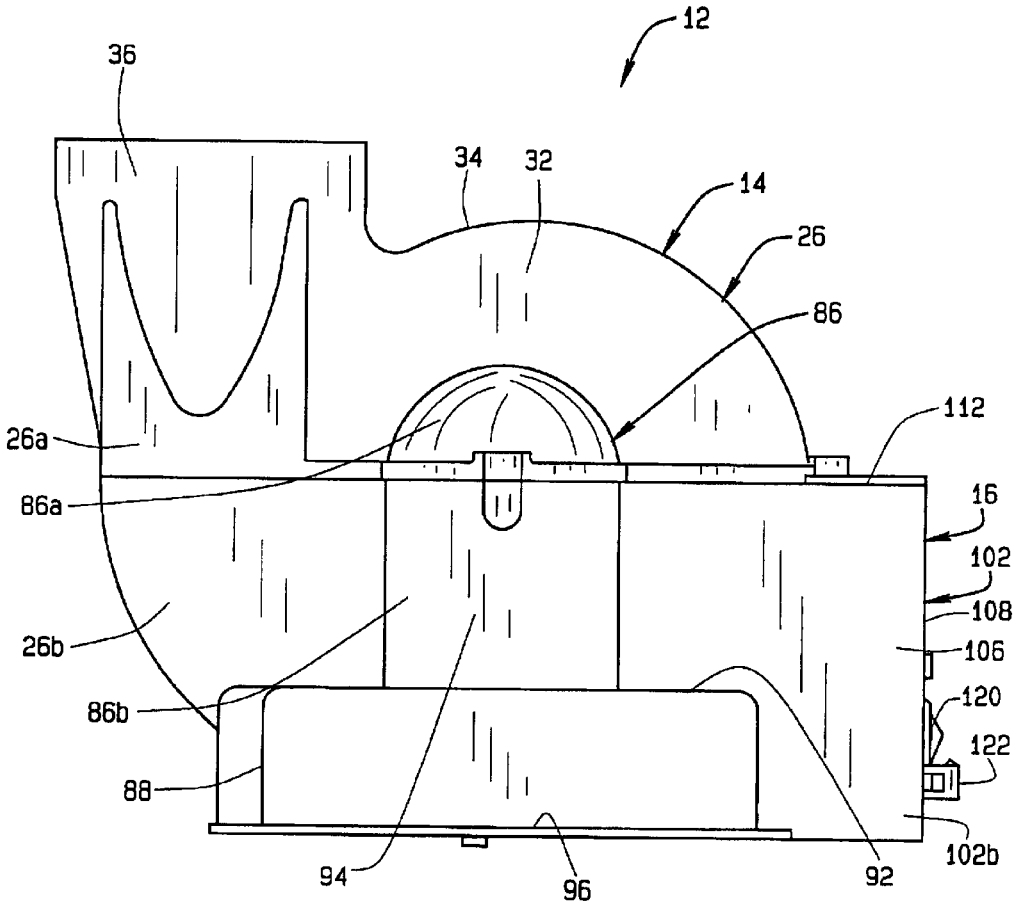
FIG. 6 is an elevation view of the opposite end of the blower housing from that shown in FIG. 5.
Figure 7:
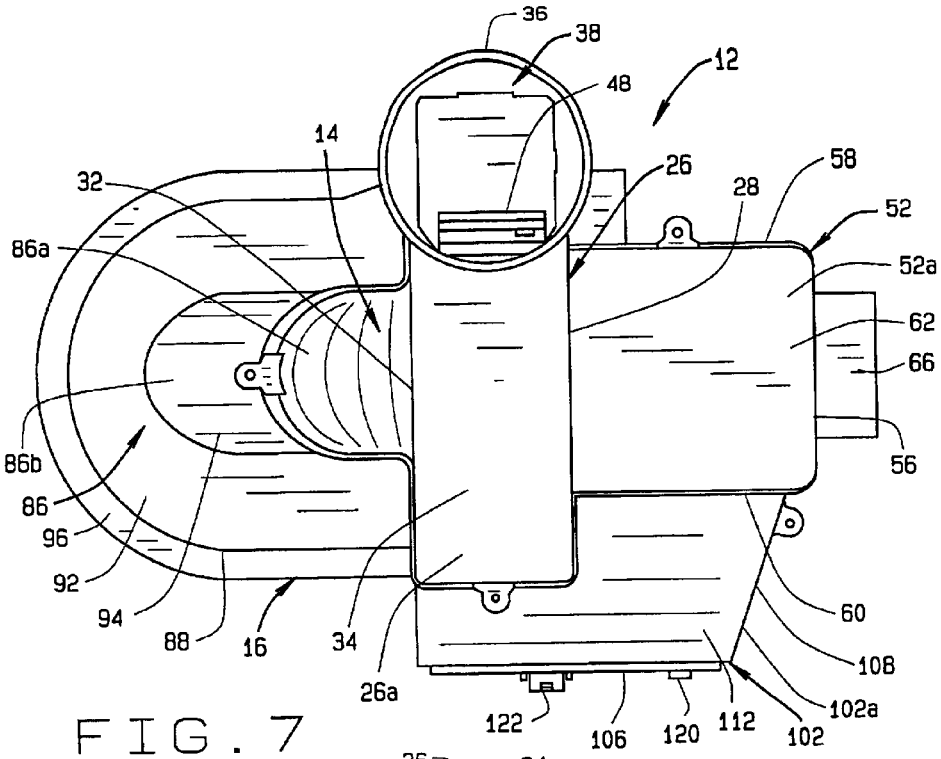
FIG. 7 is a top plan view of the blower housing of FIG. 3.

As shown in the drawing figures, the blower housing (12) of the present invention consists of two pieces including a first, top piece (14) and a second, bottom piece (16). The blower housing (12) is shown in FIGS. 1 and 2 mounted on top of a flat surface (18) of a furnace or water heater relative to the exhaust exit pipe (22) of the heater. Thus, describing the two pieces of the housing as a top piece and bottom piece describe only the relative positions of the two pieces when the housing is mounted on a top surface (18) of a heater. The blower housing (12) is equally well suited for mounting on the flat side surface of a furnace or water heater and therefore the terms "top" and "bottom" used in describing the two housing pieces should not be interpreted as limiting.

The blower housing is constructed with a fan compartment (26) that is enclosed between first and second end walls (28, 32) that are spaced from each other by a volute shaped side wall (34). The side wall (34) spirals around the peripheral edges of the two end walls (28, 32) to a generally cylindrical exhaust exit conduit (36) that emerges from the side wall (34) of the fan compartment. The conduit (36) surrounds an exhaust outlet opening (38) of the fan compartment (26) that communicates with a combustion gas or fume exhaust pipe or chimney (not shown) in use of the blower housing. A shaft hole (42) is provided through the first end wall (28) of the fan compartment and an exhaust inlet opening (44) is provided through the opposite, second end wall (32) of the fan compartment. A pressure sensor opening (46) also passes through the side wall (34) of the fan compartment. As seen in the drawing figures, the two-piece construction of the blower housing (14) divides the fan compartment (26) into a first portion **(26*a*) of the fan compartment and a second portion (26*b*) of the fan compartment that separate from each other across the shaft hole (42) and the exhaust inlet opening (44). This enables the fan (48) to be easily assembled into the interior of the fan compartment (26)**.

The blower housing (12) also includes a motor compartment (52). The motor compartment has opposite first (54)

and second (56) end walls, opposite first (58) and second (62) side walls and opposite top (64) and bottom (66) walls. The motor compartment first end wall (54) is actually a portion of the fan compartment first end wall (28) that has the shaft hole (42) extending therethrough. A cylindrical inlet vent collar (66) projects from the motor compartment second end wall (56) and surrounds an inlet vent opening (68) to the motor compartment interior. An outlet vent opening (72) passes through the motor compartment bottom wall (64) adjacent the fan compartment first end wall (28). An additional motor electrical wiring hole (74) passes through the motor compartment bottom wall (64). Motor supports (76) project inwardly from the opposite motor compartment top wall (62) and bottom wall (64) and support the motor (78) in a centered position in the motor compartment interior with the motor shaft (82) projecting through the shaft hole (42) to the fan (48) contained in the fan compartment (26). In use of the blower housing, an ambient air inlet conduit (not shown) is connected to the inlet vent collar (66) to supply cooling, ambient air to the interior of the motor compartment (52). The cooling air circulates around the motor (78) that is centered in the interior of the motor compartment (52) before exiting the motor compartment through the outlet vent opening (72).

The two-piece construction of the blower housing (12) divides the motor compartment into a first portion (52*a*) of the motor compartment and a second portion (52*b*) of the motor compartment. The line of separation between the two motor compartment portions (52*a*, 52*b*) crosses the motor shaft hole (42) and the inlet vent collar (66), facilitating the assembly of the motor (78) into the interior of the motor compartment (52).

Figure 8:
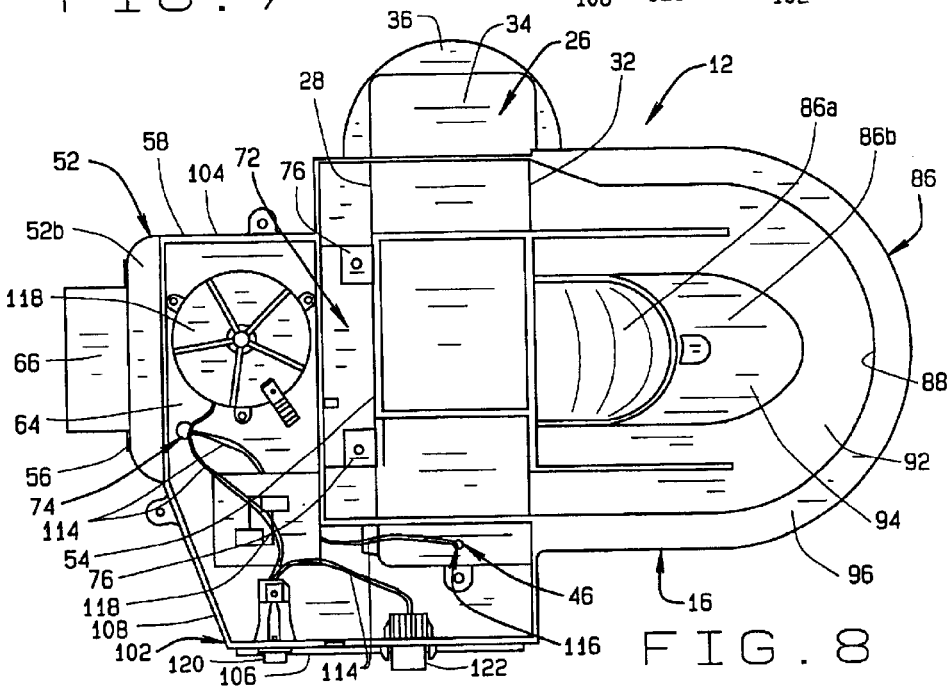
FIG. 8 is a bottom plan view of the blower housing of FIG. 3.
Figure 9:
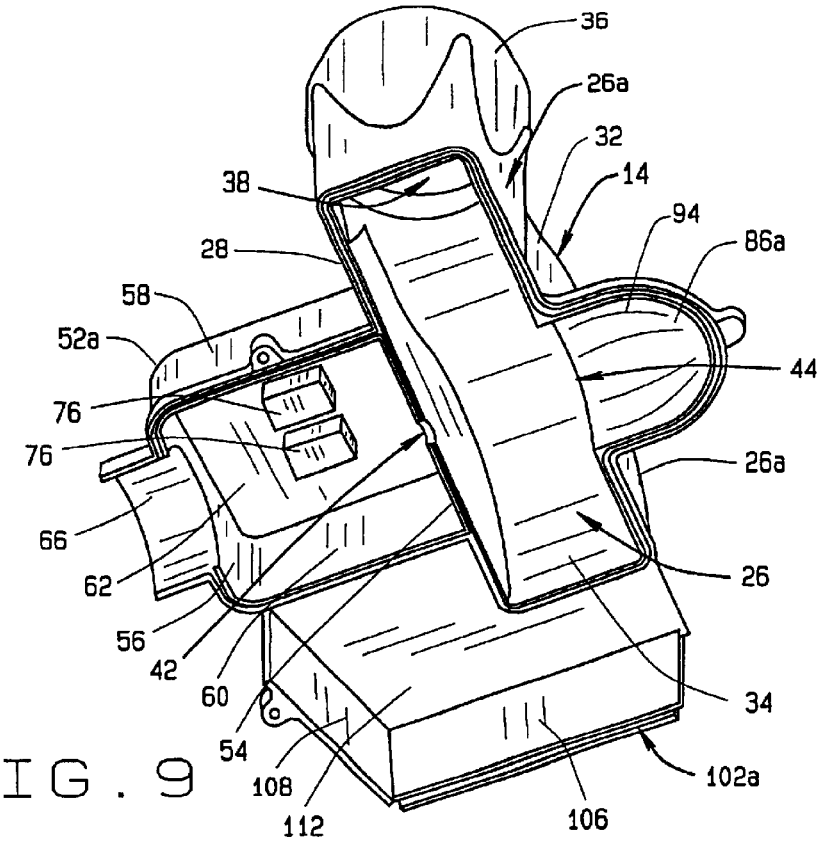
FIG. 9 is a bottom perspective view of the top piece of the blower housing.
Figure 11:
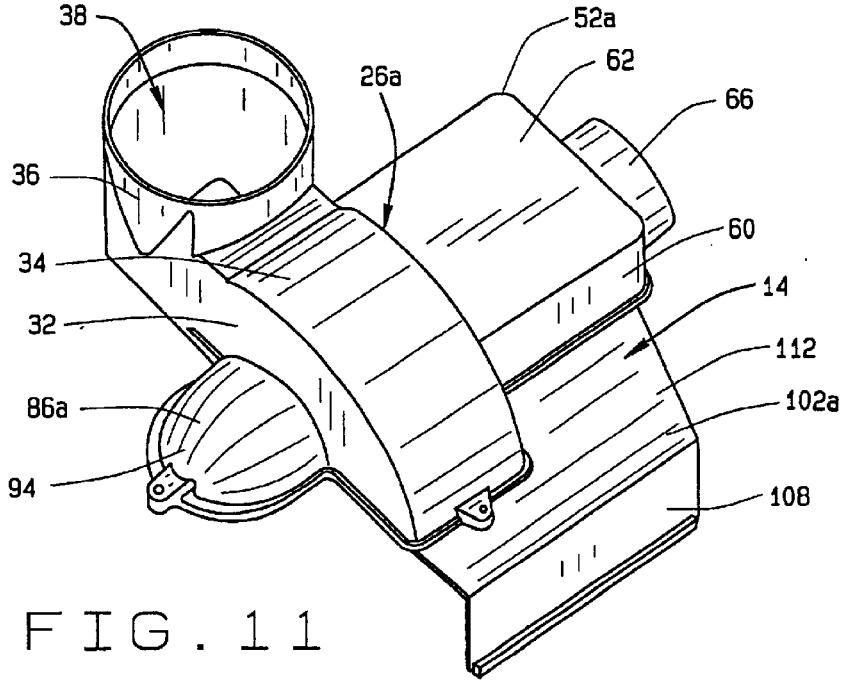
FIG. 11 is a further top perspective view of the housing top piece.
Figure 10:
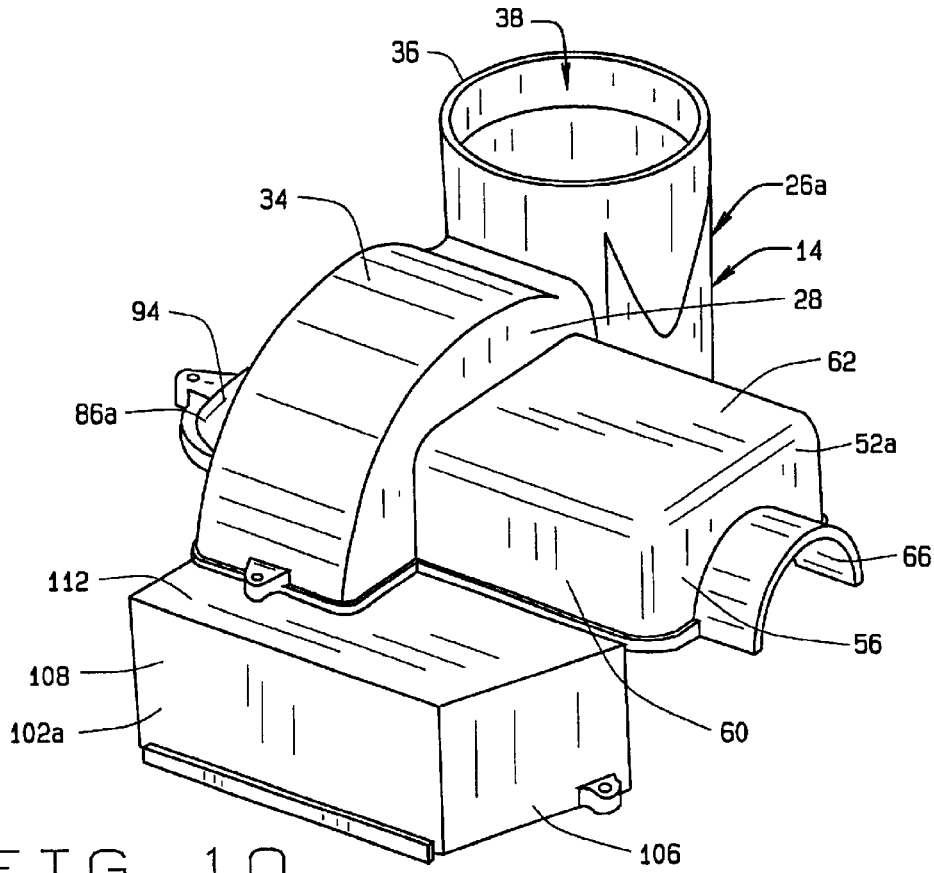
FIG. 10 is a top perspective view of the housing top piece.
Figure 12:
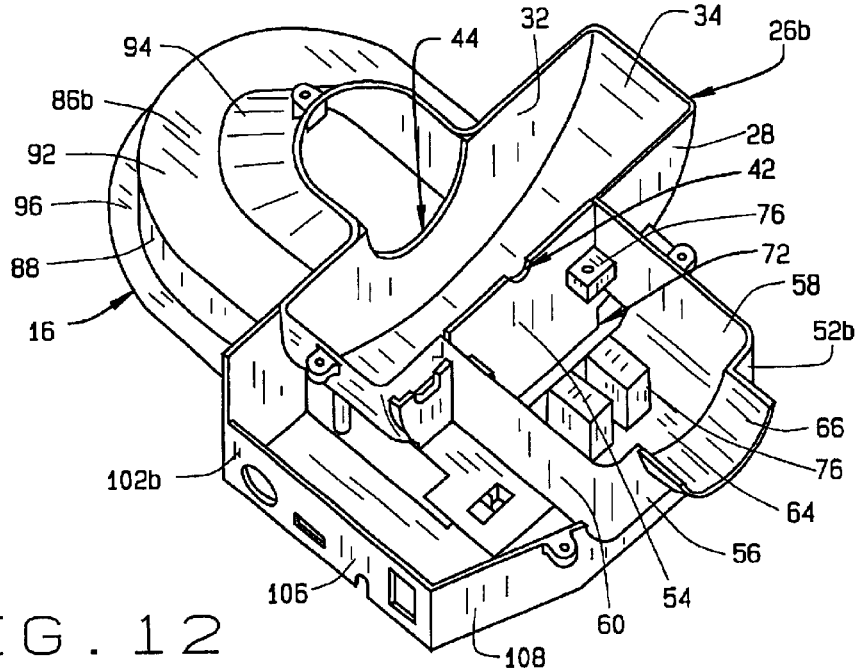
FIG. 12 is a top perspective view of the bottom piece of the blower housing.
Figure 13:
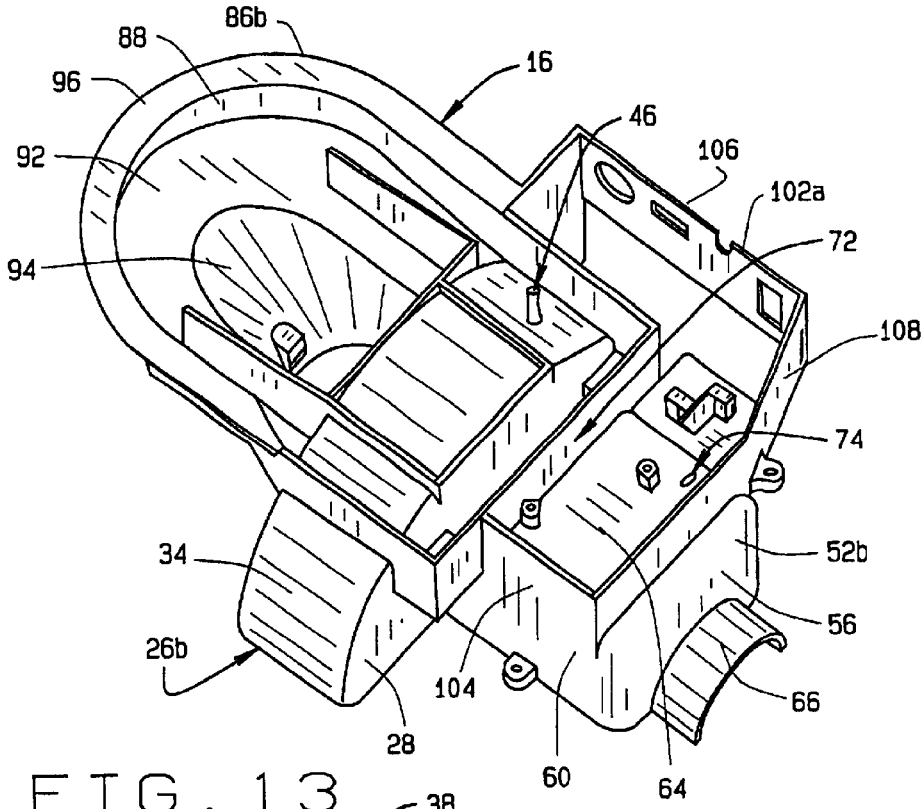
FIG. 13 is a bottom perspective view of the housing bottom piece.
Figure 14:
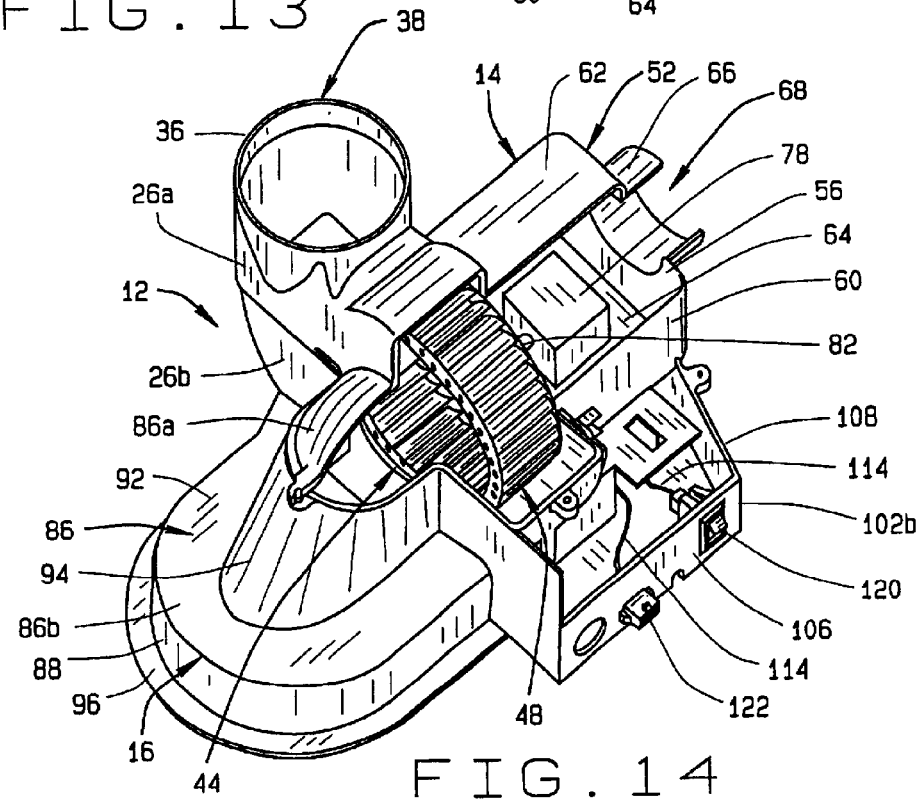
FIG. 14 is a sectioned view of one side of the assembled blower housing.

The two-piece blower housing (12) also has a dilution compartment (86) on an opposite side of the fan compartment (26) from the motor compartment (52). The dilution compartment (86) has a tombstone shaped side wall (88) that is best seen in FIG. 8. A top wall (92) extends over the side wall (88) of the dilution compartment and merges with portions of the walls of the fan compartment (26) and the motor compartment (52). A cowling wall (94) extends upwardly from the dilution compartment top wall (92) and merges with the fan compartment second end wall (32). The cowling wall (94) extends around the exhaust inlet opening (44) that passes through the fan compartment second end wall (32), thereby communicating the interior of the dilution compartment (86) with the interior of the fan compartment (26) through the exhaust inlet opening (44). As best seen in FIG. 8, the dilution compartment side wall (88) also extends around the motor compartment outlet vent opening (72), thereby communicating the interior of the dilution compartment (86) with the interior of the motor compartment (52) through the outlet vent opening (72). The two-piece construction of the blower housing (12) also divides the dilution compartment into a first portion (86*a*) of the dilution compartment and a second portion (86*b*) of the dilution compartment. The dilution compartment side wall (88) has a side wall flange (96) that projects outwardly from the side wall. The flange (96) is employed in attaching the blower housing assembly (12) to the flat surface of a heater with which the housing is used by passing threaded fasteners through the flange and the heater surface or by employing adhesives or other equivalent means of attaching the housing to the heater surface.

The blower housing (12) also includes a circuitry compartment (102) that extends below the motor compartment (52) and along portions of the sides of the motor compartment (52), the fan compartment (26) and the dilution compartment (86). Thus, portions of the walls of these compartments in combination with a pair of opposite end walls (104, 106), a side wall (108) and a top wall (114) of the circuitry compartment enclose the interior of the compartment. The circuitry compartment contains the electronic circuitry associated with the blower motor (78) and isolates the circuitry from the fan compartment (26), the motor compartment (52) and the dilution compartment (86) except for the motor wiring hole (74) and the pressure sensor opening (46). The circuitry contained in the circuitry compartment (102) includes the motor wiring (114) that passes through the motor wiring hole (74) and the pressure sensor (116) that is positioned in the pressure sensor opening (46). Several openings (118) are provided through the circuitry compartment side wall (108) for mounting switches (120) and electrical couplings (122) in the side wall that communicate with the circuitry components contained in the interior of the circuitry compartment (102). Thus, the circuitry compartment (102) contains and protects the circuitry components associated with the electric motor (78) and the pressure sensor (116) as well as other sensors and switches that are typically employed in controlling the operation of the blower motor (78) of a typical furnace or water heater. The two-piece construction of the blower housing (12) also separates the circuitry compartment into a first portion (104*a*) and a second portion (104*b*) of the compartment that separate from each other to enable easy access into the interior of the circuitry compartment (102) that facilitates assembly of the circuitry components into the blower housing.

Because much of the electronic circuitry that controls the operation of the blower motor is typically mounted on the exterior surface (18) of the furnace or water heater with which the blower is used, the circuitry compartment (102) is located at a side of the blower housing (12) that is positioned in a single plane represented by a line (124) shown in FIGS. 1 and 2. In addition, because the dilution compartment (86) communicates with the exhaust exit pipe (22) of the furnace or water heater, the dilution compartment (86) is also located at the side of the blower housing that is positioned in the single plane (124). This enables the blower housing (12) to be mounted to a flat surface (18) of the furnace or water heater with the circuitry compartment (102) enclosing the circuitry components mounted on the flat surface and with the dilution compartment (86) enclosing the exhaust exit pipe (22) of the furnace or water heater emerging from the flat surface.

The arrangement of the fan compartment (26), the motor compartment (52), the dilution compartment (86) and the circuitry compartment (102) in the blower housing described above enable the blower housing to be constructed of only two pieces with each piece being moldable of plastic or other similar material in a two-piece mold. In the two-piece housing construction, portions of the fan compartment (26), the motor compartment (52), the dilution compartment (86) and the circuitry compartment (102) are provided on each piece to facilitate assembly of the fan, the motor and the circuitry in their respective compartments. In addition, the arrangement of the compartments provides a flow path of cooling air drawn into the motor compartment (52) through the inlet vent opening (86) on actuation of the motor (78) and rotation of the fan (48). The cooling air is drawn around the motor (78) cooling the motor and exits the motor compartment through the outlet vent opening (72) at the bottom of the compartment. The air is then drawn into the dilution compartment (86) where it cools and dilutes exhaust gases and fumes that exit the furnace or water heater through the exhaust exit pipe (22). The cooled and diluted exhaust gases and fumes are then drawn into the fan compartment (26) through the exhaust inlet opening (44) and are expelled from the blower housing through the exhaust conduit outlet opening (38) to the exhaust pipe or chimney (not shown) communicating with the exhaust exit conduit (36). Thus, the two-piece blower housing provides cooling of the motor that rotates the blower fan and provides dilution and cooling of exhaust gases and fumes drawn from the furnace or water heater and is also easily mounted to a flat surface of the furnace or water heater.

While the present invention has been described by reference to a specific embodiment, it should be understood that modifications and variations of the invention may be constructed without departing from the scope of the invention as defined by the following claims.

What is claimed is:

1. A heater blower housing comprising:

a motor compartment in the heater blower housing;

a motor contained in the motor compartment;

a fan compartment in the heater blower housing;

a fan contained in the fan compartment, the fan being operatively connected to the motor for rotation of the fan by the motor;

a dilution compartment in the heater blower housing; and, a flow path through the heater blower housing extending from an exterior environment of the blower housing, through the motor compartment, then through the dilution compartment, then through the fan compartment to the exterior environment of the heater blower housing.

2. The heater blower housing of claim 1, further comprising:

a circuitry compartment in the heater blower housing; and, motor control circuitry contained in the circuitry compartment.

3. A heater blower housing comprising:

a motor compartment in the heater blower housing;

a motor contained in the motor compartment;

a fan compartment in the heater blower housing;

a fan contained in the fan compartment, the fan being operatively connected to the motor for rotation of the fan by the motor;

a dilution compartment in the heater blower housing;

a flow path through the heater blower housing extending from an exterior environment of the blower housing, through the motor compartment, then through the dilution compartment, then through the fan compartment to the exterior environment of the heater blower housing;

a circuitry compartment in the blower housing; and, motor control circuitry contained in the circuitry compartment, the motor control circuitry including a pressure sensor and a temperature sensor.

4. The heater blower housing of claim 1, further comprising:

the heater blower housing being two pieces.

5. A heater blower housing comprising:

a motor compartment in the heater blower housing;

a motor contained in the motor compartment;

a fan compartment in the heater blower housing;

a fan contained in the fan compartment, the fan being operatively connected to the motor for rotation of the fan by the motor;

a dilution compartment in the heater blower housing;

a flow path through the heater blower housing extending from an exterior environment of the blower housing, through the motor compartment, then through the dilution compartment, then through the fan compartment to the exterior environment of the heater blower housing;

the heater blower housing being two pieces; and, the two pieces being a first piece having a first portion of the motor compartment, a first portion of the fan compartment and a first portion of the dilution compartment, and a second piece having a second portion of the motor compartment, a second portion of the fan compartment and a second portion of the dilution compartment.

6. The heater blower housing of claim 4, further comprising:

the heater blower housing consists of the two pieces.

7. The heater blower housing of claim 1, further comprising:

the heater blower housing having an open side that is open to the dilution compartment and the open side being positioned in a single plane.

8. The heater blower housing of claim 7, further comprising:

the open side being open to the motor compartment.

9. A heater blower housing comprising:

a motor compartment in the heater blower housing;

a motor contained in the motor compartment;

a fan compartment in the heater blower housing;

a fan contained in the fan compartment, the fan being operatively connected to the motor for rotation of the fan by the motor;

a dilution compartment in the heater blower housing;

a flow path through the heater blower housing extending from an exterior environment of the blower housing, through the motor compartment, then through the dilution compartment, then through the fan compartment to the exterior environment of the heater blower housing;

the heater blower housing having an open side that is open to the dilution compartment and the open side being positioned in a single plane; and, a circuitry compartment in the heater blower housing and the open side being open to the circuitry compartment.

10. The heater blower housing of claim 1 further comprising:

an inlet vent opening in the heater blower housing communicating the exterior environment of the heater blower housing with the motor compartment and an outlet exhaust opening in the heater blower housing communicating the exterior environment of the heater blower housing with the fan compartment.

11. A heater blower housing comprising:

a motor compartment in the heater blower housing;

a motor contained in the motor compartment;

a fan compartment in the heater blower housing;

a fan contained in the fan compartment, the fan being operatively connected to the motor for rotation of the fan by the motor;

a dilution compartment in the heater blower housing; and, the heater blower housing consisting of two pieces.

12. A heater blower housing comprising:

a motor compartment in the heater blower housing;

a motor contained in the motor compartment;

a fan compartment in the heater blower housing;

a fan contained in the fan compartment, the fan being operatively connected to the motor for rotation of the fan by the motor;

a dilution compartment in the heater blower housing;

the heater blower housing consisting of two pieces; and, the heater blower housing having an interior wall that separates the motor compartment from the fan compartment and an interior wall that separates the dilution compartment from the fan compartment.

13. A heater blower housing comprising:

a motor compartment in the heater blower housing;

a motor contained in the motor compartment;

a fan compartment in the heater blower housing;

a fan contained in the fan compartment, the fan being operatively connected to the motor for rotation of the fan by the motor;

a dilution compartment in the heater blower housing;

the heater blower housing consisting of two pieces; and, the two pieces being a first piece having a first portion of the motor compartment and a first portion of the fan compartment, and a second piece having a second portion of the motor compartment and a second portion of the fan compartment.

14. The heater blower housing of claim 13 further comprising:

the first piece having a first portion of the dilution compartment and the second piece having a second portion of the dilution compartment.

15. The heater blower housing of claim 13 further comprising:

a circuitry compartment in the heater blower housing; and, motor control circuitry contained in the circuitry compartment.

16. The heater blower housing of claim 13 further comprising:

the first piece having a first portion of the circuitry compartment and the second piece having a second portion of the circuitry compartment.

17. The heater blower housing of claim 11 further comprising:

the heater blower housing having an open side that is open to the dilution compartment and the open side being positioned in a single plane.

18. The heater blower housing of claim 13 further comprising:

the heater blower housing having an open side that is open to the dilution compartment and the circuitry compartment.

19. The heater blower housing of claim 18 further comprising:

the open side being positioned in a single plane.

20. A heater blower housing comprising:

a motor compartment in the heater blower housing, the motor compartment having a motor compartment wall that encloses an interior of the motor compartment;

a motor contained in the motor compartment interior;

a fan compartment in the heater blower housing, the fan compartment having a fan compartment wall that encloses an interior of the fan compartment;

a fan contained in the fan compartment, the fan being operatively connected to the motor for rotation of the fan by the motor;

a dilution compartment in the heater blower housing, the dilution compartment having a dilution compartment wall that encloses an interior of the dilution compartment;

a circuitry compartment in the heater blower housing, the circuitry compartment having a circuitry compartment wall that encloses an interior of the circuitry compartment;

motor control circuitry contained in the circuitry compartment interior, the motor control circuitry being operatively connected to the motor to control the motor; and, the heater blower housing having an open side that is open to the dilution compartment and the circuitry compartment, the open side being positioned in a single plane.

21. A heater blower housing comprising:

a motor compartment in the heater blower housing, the motor compartment having a motor compartment wall that encloses an interior of the motor compartment;

a motor contained in the motor compartment interior;

a fan compartment in the heater blower housing, the fan compartment having a fan compartment wall that encloses an interior of the fan compartment;

a fan contained in the fan compartment, the fan being operatively connected to the motor for rotation of the fan by the motor;

a dilution compartment in the heater blower housing, the dilution compartment having a dilution compartment wall that encloses an interior of the dilution compartment;

a circuitry compartment in the heater blower housing, the circuitry compartment having a circuitry compartment wall that encloses an interior of the circuitry compartment;

motor control circuitry contained in the circuitry compartment interior, the motor control circuitry being operatively connected to the motor to control the motor;

the heater blower housing having an open side that is open to the dilution compartment and the circuitry compartment, the open side being positioned in a single plane; and, the dilution compartment wall and the circuitry compartment wall intersecting the single plane.

22. A heater blower housing comprising:

a motor compartment in the heater blower housing, the motor compartment having a motor compartment wall that encloses an interior of the motor compartment;

a motor contained in the motor compartment interior;

a fan compartment in the heater blower housing, the fan compartment having a fan compartment wall that encloses an interior of the fan compartment;

a fan contained in the fan compartment, the fan being operatively connected to the motor for rotation of the fan by the motor;

a dilution compartment in the heater blower housing, the dilution compartment having a dilution compartment wall that encloses an interior of the dilution compartment;

a circuitry compartment in the heater blower housing, the circuitry compartment having a circuitry compartment wall that encloses an interior of the circuitry compartment;

motor control circuitry contained in the circuitry compartment interior, the motor control circuitry being operatively connected to the motor to control the motor;

the heater blower housing having an open side that is open to the dilution compartment and the circuitry compartment, the open side being positioned in a single plane; and, the circuitry compartment wall separating the circuitry compartment from the dilution compartment.

23. A heater blower housing comprising:

a motor compartment in the heater blower housing, the motor compartment having a motor compartment wall that encloses an interior of the motor compartment;

a motor contained in the motor compartment interior;

a fan compartment in the heater blower housing, the fan compartment having a fan compartment wall that encloses an interior of the fan compartment;

a fan contained in the fan compartment, the fan being operatively connected to the motor for rotation of the fan by the motor;

a dilution compartment in the heater blower housing, the dilution compartment having a dilution compartment wall that encloses an interior of the dilution compartment;

a circuitry compartment in the heater blower housing, the circuitry compartment having a circuitry compartment wall that encloses an interior of the circuitry compartment;

motor control circuitry contained in the circuitry compartment interior, the motor control circuitry being operatively connected to the motor to control the motor;

the heater blower housing having an open side that is open to the dilution compartment and the circuitry compartment, the open side being positioned in a single plane; and, the circuitry compartment wall separating the circuitry compartment from the motor compartment.

24. The heater blower housing of claim 20 further comprising:

the motor compartment wall having an inlet vent opening and an outlet vent opening.

25. The heater blower housing of claim 24 further comprising:

the fan compartment wall having an inlet exhaust opening and an outlet exhaust opening.

26. A heater blower housing comprising:

a motor compartment in the heater blower housing, the motor compartment having a motor compartment wall that encloses an interior of the motor compartment;

a motor contained in the motor compartment interior;

a fan compartment in the heater blower housing, the fan compartment having a fan compartment wall that encloses an interior of the fan compartment;

a fan contained in the fan compartment, the fan being operatively connected to the motor for rotation of the fan by the motor;

a dilution compartment in the heater blower housing, the dilution compartment having a dilution compartment wall that encloses an interior of the dilution compartment;

a circuitry compartment in the heater blower housing, the circuitry compartment having a circuitry compartment wall that encloses an interior of the circuitry compartment;

motor control circuitry contained in the circuitry compartment interior, the motor control circuitry being operatively connected to the motor to control the motor;

the heater blower housing having an open side that is open to the dilution compartment and the circuitry compartment, the open side being positioned in a single plane;

the motor compartment wall having an inlet vent opening and an outlet vent opening;

the fan compartment wall having an inlet exhaust opening and an outlet exhaust opening; and, the dilution compartment interior communicating with the motor compartment interior through the outlet vent opening and the dilution compartment interior communicating with the fan compartment interior through the exhaust inlet opening.

27. The heater blower housing of claim 25 further comprising:

the motor compartment communicating with an exterior environment of the heater blower housing through the inlet vent opening and the fan compartment communicating with an exterior environment of the heater blower housing through the outlet exhaust opening.

* * * * *